US009718666B2

(12) United States Patent
Cornett

(10) Patent No.: US 9,718,666 B2
(45) Date of Patent: Aug. 1, 2017

(54) FUEL DISPENSING NOZZLE WITH ULTRASONIC TRANSDUCER FOR REGULATING FUEL FLOW RATES

(71) Applicant: Veeder-Root Company, Simsbury, CT (US)

(72) Inventor: Kenneth D. Cornett, Simsbury, CT (US)

(73) Assignee: Veeder-Root Company, Simsbury, CT (US)

( * ) Notice: Subject to any disclaimer, the term of this patent is extended or adjusted under 35 U.S.C. 154(b) by 0 days.

(21) Appl. No.: 14/964,098

(22) Filed: Dec. 9, 2015

(65) Prior Publication Data

US 2016/0167942 A1 Jun. 16, 2016

Related U.S. Application Data

(60) Provisional application No. 62/090,925, filed on Dec. 12, 2014.

(51) Int. Cl.
*B67D 7/12* (2010.01)
*B67D 7/42* (2010.01)

(52) U.S. Cl.
CPC ..... *B67D 7/12* (2013.01); *B67D 7/425* (2013.01)

(58) Field of Classification Search
CPC ..... B67D 7/08; B67D 7/12
USPC ..... 141/59, 206, 219
See application file for complete search history.

(56) References Cited

U.S. PATENT DOCUMENTS

| | | | | |
|---|---|---|---|---|
| 3,291,928 | A | 12/1966 | Reid et al. | |
| 3,653,415 | A | 4/1972 | Boudot et al. | |
| 4,005,412 | A | 1/1977 | Leander | |
| 4,140,013 | A | 2/1979 | Hunger | |
| 4,453,578 | A | 6/1984 | Wilder | |
| 4,527,433 | A | 7/1985 | Gutterman | |
| 4,528,857 | A * | 7/1985 | Bruner | G01F 1/667 73/861.05 |
| 4,735,243 | A | 4/1988 | Ehlers | |
| 4,930,665 | A | 6/1990 | Devine | |
| 4,934,419 | A | 6/1990 | Lamont et al. | |
| 4,934,565 | A | 6/1990 | Heisey et al. | |
| 5,040,577 | A | 8/1991 | Pope | |

(Continued)

OTHER PUBLICATIONS

International Search Report and Written Opinion dated Feb. 16, 2016 for corresponding PCT Application No. PCT/US15/65073.

(Continued)

*Primary Examiner* — Timothy L Maust
(74) *Attorney, Agent, or Firm* — Nelson Mullins Riley & Scarborough, LLP

(57) ABSTRACT

Systems and methods for regulating the flow rate of fluid at a fluid dispensing nozzle. In one embodiment, a nozzle includes a body, a spout coupled with the body, and at least one fluid flow path disposed within the body. The at least one fluid flow path is configured for fluid communication with a fluid dispensing hose. An ultrasonic transducer is disposed within the body and operatively coupled with the at least one flow path. Control electronics are in electronic communication with the ultrasonic transducer. The control electronics are operative to cause the ultrasonic transducer to transmit ultrasonic waves into the at least one fluid flow path. The ultrasonic waves are modulated with information representative of a desired fluid flow rate.

22 Claims, 5 Drawing Sheets

(56) References Cited

U.S. PATENT DOCUMENTS

| | | | | | |
|---|---|---|---|---|---|
| 5,184,309 | A | | 2/1993 | Simpson et al. | |
| 5,249,612 | A | * | 10/1993 | Parks | B67D 7/348 141/219 |
| 5,365,984 | A | | 11/1994 | Simpson et al. | |
| 5,505,234 | A | * | 4/1996 | Simpson | B67D 7/425 141/206 |
| 5,689,071 | A | | 11/1997 | Ruffner et al. | |
| 5,734,851 | A | | 3/1998 | Leatherman et al. | |
| 5,832,970 | A | | 11/1998 | Carow | |
| 5,954,080 | A | | 9/1999 | Leatherman | |
| 5,956,259 | A | | 9/1999 | Hartsell, Jr. et al. | |
| 6,019,146 | A | * | 2/2000 | Taylor | B67D 7/16 141/100 |
| 6,052,629 | A | | 4/2000 | Leatherman et al. | |
| 6,390,999 | B1 | | 5/2002 | Zscheile et al. | |
| 6,435,204 | B2 | | 8/2002 | White et al. | |
| 6,571,151 | B1 | | 5/2003 | Leatherman | |
| 6,935,191 | B2 | | 8/2005 | Olivier et al. | |
| 7,010,961 | B2 | | 3/2006 | Hutchinson et al. | |
| 7,134,580 | B2 | | 11/2006 | Garrison et al. | |
| 7,289,877 | B2 | | 10/2007 | Wilson | |
| 7,954,387 | B1 | | 6/2011 | Furlong | |
| 7,966,893 | B2 | | 6/2011 | Straub, Jr. | |
| 8,284,053 | B2 | | 10/2012 | DeLine | |
| 8,539,991 | B1 | | 9/2013 | Carmack et al. | |
| 8,616,252 | B2 | | 12/2013 | Clever et al. | |
| 2012/0006127 | A1 | | 1/2012 | Nielsen | |
| 2012/0125478 | A1 | | 5/2012 | Clever et al. | |

OTHER PUBLICATIONS

Rudraraju, Vrs Raju, Ultrasonic Data Communication Through Petroleum, Masters Thesis, May 2010, University of Akron.

* cited by examiner

FUEL DISPENSING NOZZLE WITH ULTRASONIC TRANSDUCER FOR REGULATING FUEL FLOW RATES

PRIORITY CLAIM

This application claims the benefit of U.S. Provisional Application Ser. No. 62/090,925, titled "Fuel Dispensing Nozzle with Ultrasonic Transducer for Regulating Fuel Flow Rates," filed Dec. 12, 2014, which is hereby relied upon and incorporated herein by reference for all purposes.

BACKGROUND

The present invention relates generally to equipment used in fuel dispensing environments. More specifically, embodiments of the present invention relate to regulating fluid flow rates at a fluid dispensing nozzle via ultrasonic communications transmitted along a fluid hose extending between the nozzle and an associated fluid dispenser.

Nozzles used for dispensing fuel in a retail fueling environment are well known. Background information regarding such nozzles is provided in U.S. Pat. Nos. 8,539,991; 5,832,970; 4,735,243; and 4,453,578, the disclosure of each of which is incorporated by reference herein in its entirety for all purposes. These nozzles typically include a variety of mechanical components used to handle the flow of fuel and, in some cases, recovered vapor, for example including main and secondary poppet valves and overfill detection and attitude shutoff devices. It has also been proposed to include a variety of other flow handling components in fuel dispensing nozzles, such as fuel flow meters, flow control valves, and fuel and vapor sensors, among others. However, increasing the number of components in a nozzle increases the cost and complexity of the nozzle, which is undesirable for a device that is frequently subject to rough handling and constant wear. Increasing the number of components also increases the weight of the nozzle, which may make it unwieldy for some users.

In addition, attempts have been made to include various electronic components in a fuel dispensing nozzle. For instance, such components include user interfaces, displays, basic controller functions, and payment input devices. Further, it has been proposed to transmit information to and from a fuel dispensing nozzle via fiber optic, infrared, and electromagnetic signals. Nonetheless, these efforts have been largely unacceptable for a variety of reasons, including the difficulty of providing electrical power at the nozzle in a safe manner and the practical problems with transmitting signals between the fuel dispenser and the nozzle. For example, nozzle hoses are frequently twisted and turned in use, and thus running a wire between the fuel dispenser and the nozzle would subject the wire to undue (and potentially unsafe) wear. Moreover, with respect to electromagnetic transmissions, emissions from lighting and motors, among other components, may cause electromagnetic interference (EMI) that adversely affects the signals sent between the nozzle and the fuel dispenser. Similarly, depending on the operating frequency and the system chosen, transmissions from the fuel dispenser or the nozzle may be adversely affected by EMI from consumer electronics devices operating in unlicensed frequency bands (such as cell phones, tablets, and game consoles incorporating WiFi, Bluetooth, or Zigbee communications electronics).

SUMMARY

The present invention recognizes and addresses various considerations of prior art constructions and methods.

According to one embodiment, the present invention provides a nozzle comprising a body, a spout coupled with the body, and at least one fluid flow path disposed within the body. The at least one fluid flow path is configured for fluid communication with a fluid dispensing hose. An ultrasonic transducer is disposed within the body and operatively coupled with the at least one flow path. Control electronics are in electronic communication with the ultrasonic transducer. The control electronics are operative to cause the ultrasonic transducer to transmit ultrasonic waves into the at least one fluid flow path. The ultrasonic waves are modulated with information representative of a desired fluid flow rate.

According to another embodiment, the present invention provides a fluid dispenser comprising a housing, at least one fluid flow path disposed within the housing, the at least one fluid flow path configured for fluid communication with a fluid dispensing hose, and a control system. An ultrasonic transducer is in electronic communication with the control system, and the ultrasonic transducer is operatively coupled with the at least one flow path. At least one flow control component is in electronic communication with the control system, and the at least one flow control component is disposed along the at least one fluid flow path. The at least one flow control component is operative to adjust the flow rate of fluid in the at least one fluid flow path. The ultrasonic transducer is operative to receive ultrasonic waves propagating along the at least one flow path. The ultrasonic waves are modulated with information representative of a desired fluid flow rate.

In yet another embodiment, the present invention provides a method of regulating the flow rate of fluid at a nozzle in fluid communication with a fluid dispenser. The method comprises transmitting, from an ultrasonic transducer located in the nozzle, ultrasonic waves modulated with information representative of a desired fluid flow rate. The ultrasonic waves propagate along a fluid dispensing hose extending between the nozzle and the fluid dispenser. The method also comprises receiving, at an ultrasonic transducer located in the fluid dispenser, the ultrasonic waves modulated with information representative of the desired fluid flow rate. Further, the method comprises demodulating the ultrasonic waves to obtain the information representative of the desired fluid flow rate. Finally, the method comprises adjusting at least one flow control component disposed along a flow path in the fluid dispenser based on the information representative of the desired fluid flow rate.

Those skilled in the art will appreciate the scope of the present invention and realize additional aspects thereof after reading the following detailed description of preferred embodiments in association with the accompanying drawing figures.

BRIEF DESCRIPTION OF THE DRAWINGS

A full and enabling disclosure of the present invention, including the best mode thereof directed to one skilled in the art, is set forth in the specification, which makes reference to the appended drawings, in which.

Figure 1:
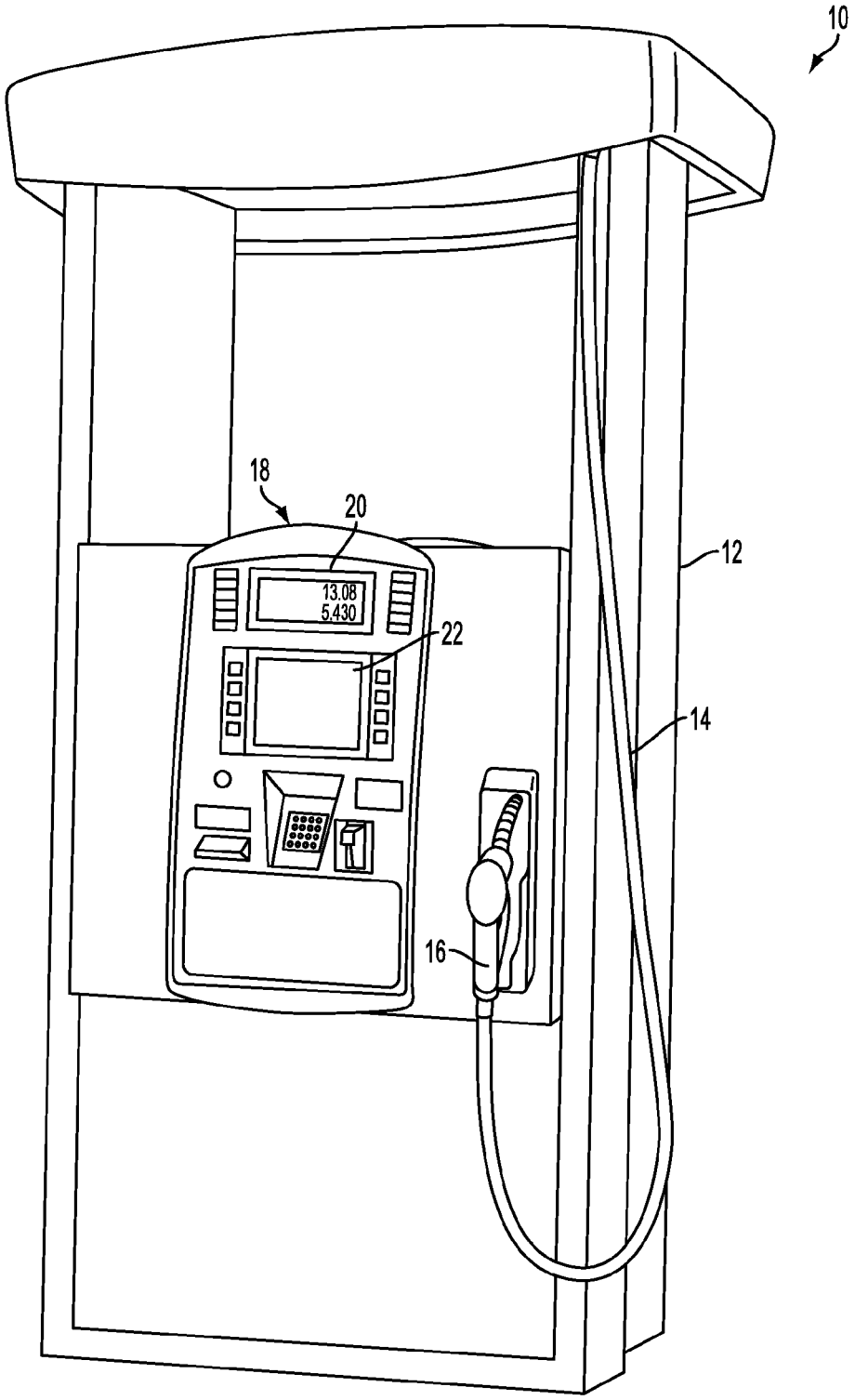
FIG. 1 PRIOR ART
FIG. 1 is a perspective view of a prior art fuel dispenser for use in a retail service station environment.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the present disclosure including the appended claims and their equivalents.

Some embodiments of the present invention may be particularly suitable for use with a fuel dispenser in a retail service station environment, and the below discussion will describe some preferred embodiments in that context. However, those of skill in the art will understand that the present invention is not so limited. In fact, it is contemplated that embodiments of the present invention may be used with any fluid dispensing environment and with fluid dispensing nozzles associated with other fluid dispensers. For example, embodiments of the present invention may also be used with nozzles associated with diesel exhaust fluid (DEF) dispensers, compressed natural gas (CNG) dispensers, and liquefied petroleum gas (LPG) and liquid natural gas (LNG) applications, among others.

FIG. 1 is a perspective view of a prior art fuel dispenser 10 adapted for use in a retail service station environment. Fuel dispenser 10 may be similar to, for example, the ENCORE® dispenser sold by Gilbarco Inc. of Greensboro, N.C. Fuel dispenser 10 includes a housing 12 with a flexible fuel hose 14 extending therefrom. Fuel hose 14 terminates in a manually-operated nozzle 16 adapted to be inserted into a fill neck of a vehicle's fuel tank. Nozzle 16 includes a fuel valve. Various fuel handling components, such as valves and meters, are also located inside of housing 12. These fuel handling components allow fuel to be received from underground piping and delivered through hose 14 and nozzle 16 to a vehicle's tank, as is well understood.

Fuel dispenser 10 has a customer interface 18. Customer interface 18 may include an information display 20 relating to an ongoing fueling transaction that includes the amount of fuel dispensed and the price of the dispensed fuel. Further, customer interface 18 may include a media display 22 to provide advertising, merchandising, and multimedia presentations to a customer in addition to basic transaction functions. The graphical user interface provided by the dispenser allows customers to purchase goods and services other than fuel at the dispenser. Further, display 22 may provide instructions to the customer regarding the fueling transaction. Further information on and examples of fuel dispensers and retail fueling environments are provided in U.S. Pat. Nos. 6,435,204; 5,956,259; 5,734,851; 6,052,629; 5,689,071; 6,935,191; and 7,289,877, all of which are incorporated herein by reference in their entireties for all purposes.

Figure 2:
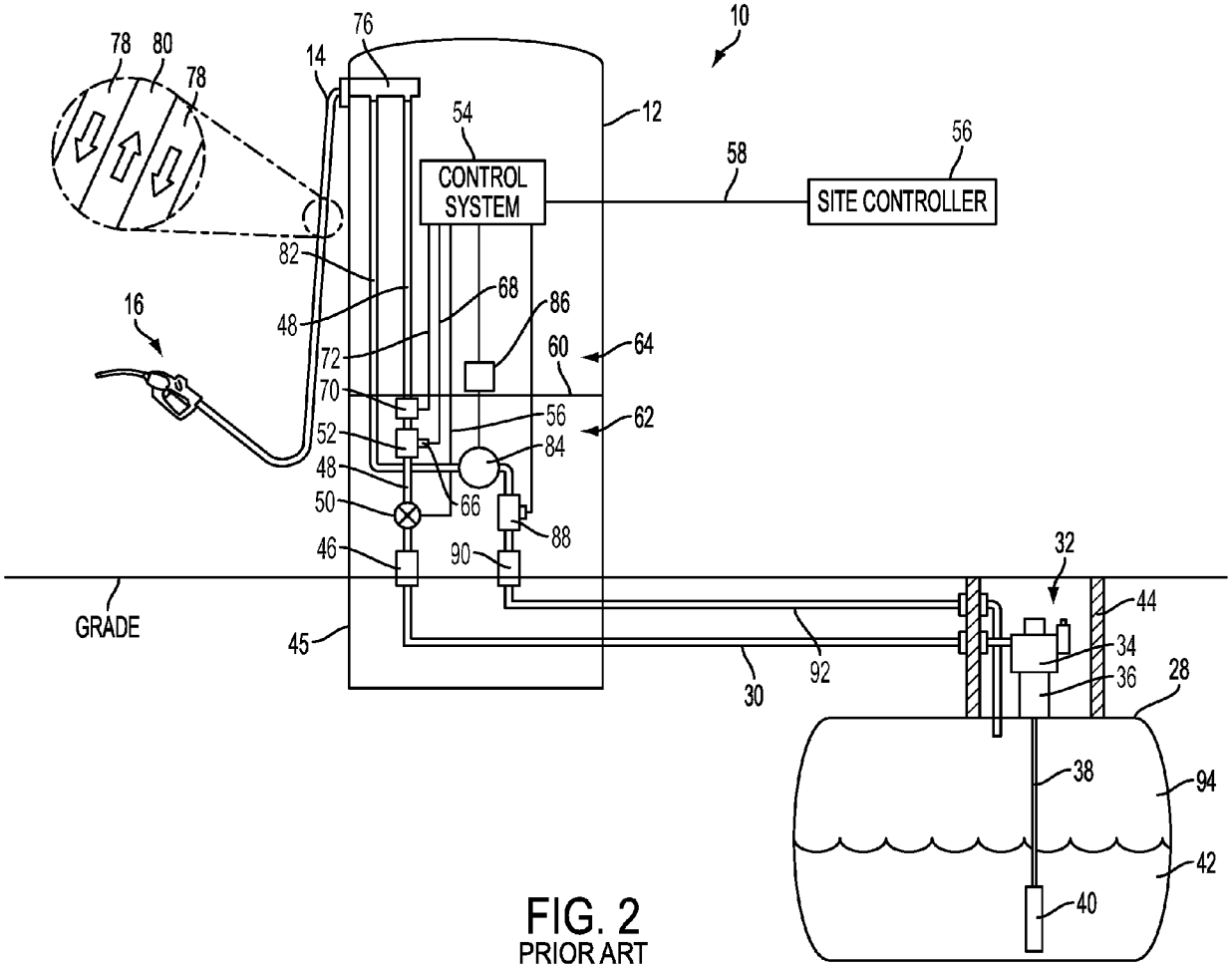
FIG. 2 PRIOR ART
FIG. 2 is a schematic illustration of a prior art fuel dispensing system including the dispenser of FIG. 1.

FIG. 2 is a schematic illustration of a prior art fuel dispensing system in a retail service station environment. In general, fuel may travel from an underground storage tank (UST) 28 via main fuel piping 30, which may be a double-walled pipe having secondary containment as is well known, to fuel dispenser 10 and nozzle 16 for delivery. An exemplary underground fuel delivery system is illustrated in U.S. Pat. No. 6,435,204, hereby incorporated by reference in its entirety for all purposes.

More specifically, a submersible turbine pump (STP) 32 associated with the UST 28 is used to pump fuel to the fuel dispenser 10. However, some fuel dispensers may be self-contained, meaning fuel is drawn to the fuel dispenser 10 by a pump controlled by a pump unit positioned within housing 12.

STP 32 is comprised of a distribution head 34 containing power and control electronics that provide power through a riser 36 down to a boom 38 inside the UST 28, eventually reaching a turbine pump contained inside an outer turbine pump housing 40. STP 32 may preferably be the RED JACKET® submersible turbine pump, manufactured by the Veeder-Root Co. of Simsbury, Conn. Also, STP 32 may contain a siphon that allows the STP 32 to generate a vacuum using the force of fuel flow. In addition, riser 36 and distribution head 34 may be secondarily contained to capture and monitor leaks. For example, such a system is disclosed in U.S. Pat. No. 7,010,961, hereby incorporated by reference in its entirety for all purposes. As noted above, there may be a plurality of USTs 28 and STPs 32 in a service station environment if more than one type or grade of fuel 42 is to be delivered by a fuel dispenser 10.

The turbine pump operates to draw fuel 42 upward from the UST 28 into the boom 38 and riser 36 for delivery to the fuel dispenser 10. After STP 32 draws the fuel 42 into the distribution head 34, the fuel 42 is carried through STP sump 44 to main fuel piping 30. Main fuel piping 30 carries fuel 42 through dispenser sump 45 to the fuel dispenser 10 for eventual delivery. Those of skill in the art will appreciate that dispenser sump 45, which may also be double-walled, is adapted to capture any leaked fuel 42 that drains from fuel dispenser 10 and its fuel handling components so that fuel 42 is not leaked into the ground.

Main fuel piping 30 may then pass into housing 12 through a product line shear valve 46. As is well known, product line shear valve 46 is designed to close the fuel flow path in the event of an impact to fuel dispenser 10. U.S. Pat. No. 8,291,928, hereby incorporated by reference in its entirety for all purposes, discloses an exemplary secondarily-contained shear valve adapted for use in service station environments. Product line shear valve 46 contains an internal fuel flow path to carry fuel 42 from main fuel piping 30 to internal fuel piping 48, which may also be double-walled.

After fuel 42 exits the outlet of shear valve 46 and enters into internal fuel piping 48, it may encounter a flow control valve 50 positioned upstream of a flow meter 52. In some prior art fuel dispensers, valve 50 may be positioned downstream of the flow meter 52. In one embodiment, valve 50 may be a proportional solenoid controlled valve, such as described in U.S. Pat. No. 5,954,080, hereby incorporated by reference in its entirety for all purposes.

Flow control valve 50 is under control of a control system 54 via a flow control valve signal line 56. In this manner, control system 54 can control the opening and closing of flow control valve 50 to either allow fuel to flow or not flow through meter 52 and on to the hose 14 and nozzle 16. Control system 54 may be any suitable electronics with associated memory and software programs running thereon whether referred to as a processor, microprocessor, controller, microcontroller, or the like. In a preferred embodiment, control system 54 may be comparable to the microprocessor-based control systems used in CRIND and TRIND type units sold by Gilbarco Inc. Control system 54 typically controls other aspects of fuel dispenser 10, such as valves, displays, and the like as is well understood. For example, control system 54 typically instructs flow control valve 50 to open when a fueling transaction is authorized. In addition, control system 54 may be in electronic communication with a site controller 26 via a fuel dispenser communication network 58. Communication network 58 may be any suitable link, such as two wire, RS 422, Ethernet, wireless, etc. as needed or desired. Site controller 26 communicates with control system 54 to control authorization of fueling transactions and other conventional activities. The site controller functions may preferably be provided by the PASSPORT® point-of-sale system manufactured by Gilbarco Inc.

The memory of control system 54 may be any suitable memory or computer-readable medium as long as it is capable of being accessed by the control system, including random access memory (RAM), read-only memory (ROM), erasable programmable ROM (EPROM), or electrically EPROM (EEPROM), CD-ROM, DVD, or other optical disk storage, solid-state drive (SSD), magnetic disc storage, including floppy or hard drives, any type of suitable non-volatile memories, such as secure digital (SD), flash memory, memory stick, or any other medium that may be used to carry or store computer program code in the form of computer-executable programs, instructions, or data. Control system 54 may also include a portion of memory accessible only to control system 54.

Flow control valve 50 is contained below a vapor barrier 60 in a hydraulics compartment 62 of fuel dispenser 10. Control system 54 is typically located in an electronics compartment 64 of fuel dispenser 10 above vapor barrier 60. After fuel 42 exits flow control valve 50, it typically flows through meter 52, which preferably measures the flow rate of fuel 42. In some embodiments, meter 52 may be capable of measuring the density and/or temperature of the flowing fuel.

Flow meter 52 may be any suitable flow meter known to those of skill in the art, including positive displacement, inferential, and Coriolis mass flow meters, among others. Meter 52 typically comprises electronics 66 that communicates information representative of the flow rate, density, and/or temperature of fuel to control system 54 via a signal line 68. For example, electronics 66 may typically include a pulser as known to those skilled in the art. In this manner, control system 54 can update the total gallons (or liters) dispensed and the price of the fuel dispensed on information display 20.

As fuel leaves flow meter 52 it enters a flow switch 70. Flow switch 70, which preferably comprises a one-way check valve that prevents rearward flow through fuel dispenser 10, generates a flow switch communication signal via flow switch signal line 72 to control system 54 to communicate when fuel 42 is flowing through flow meter 52. The flow switch communication signal indicates to control system 54 that fuel is actually flowing in the fuel delivery path and that subsequent signals from flow meter 52 are due to actual fuel flow.

After fuel 42 enters flow switch 70, it exits through internal fuel piping 48 to be delivered to a blend manifold 76. Blend manifold 76 receives fuels of varying octane levels from the various USTs and ensures that fuel of the octane level selected by the customer is delivered. After flowing through blend manifold 76, fuel 42 passes through fuel hose 14 and nozzle 16 for delivery to the customer's vehicle.

In this case, fuel dispenser 10 comprises a vapor recovery system to recover fuel vapors through nozzle 16 and hose 14 to return to UST 28. An example of a vapor recovery assist equipped fuel dispenser is disclosed in U.S. Pat. No. 5,040,577, incorporated by reference herein in its entirety for all purposes. More particularly, flexible fuel hose 14 is coaxial and includes a product delivery line 78 and a vapor return line 80. Both lines 78 and 80 are fluidly connected to UST 28 through fuel dispenser 10. Lines 78 and 80 diverge internal to dispenser 10 at manifold 76, such that product delivery line 78 is fluidly coupled to internal fuel piping 48 and vapor return line 80 is fluidly coupled to internal vapor return piping 82. During delivery of fuel into a vehicle's fuel tank, the incoming fuel displaces air in the fuel tank containing fuel vapors. Vapor may be recovered from the vehicle's fuel tank through vapor return line 80 and returned to UST 28 with the assistance of a vapor pump 84. A motor 86 may operate vapor pump 84. Internal vapor return piping 82 is coupled to a vapor flow meter 88. Vapor flow meter 88, which measures vapor collected by the nozzle 16 when fuel 42 is dispensed, may be used for in-station diagnostics and monitoring or control of vapor recovery. In some embodiments, vapor flow meter 88 may also be a Coriolis mass flow meter.

After the recovered vapor passes through vapor flow meter 88, the recovered vapor passes to vapor line shear valve 90 (which may be analogous to product line shear valve 46). Finally, the recovered vapor returns to UST 28 via vapor return piping 92. Vapor return piping 92 is fluidly coupled to the ullage 94 of UST 28. Thus, the recovered vapor is recombined with the vapor in ullage 94 to prevent vapor emissions from escaping to the atmosphere. The vapors recombine and liquefy into fuel 42.

Figure 3:
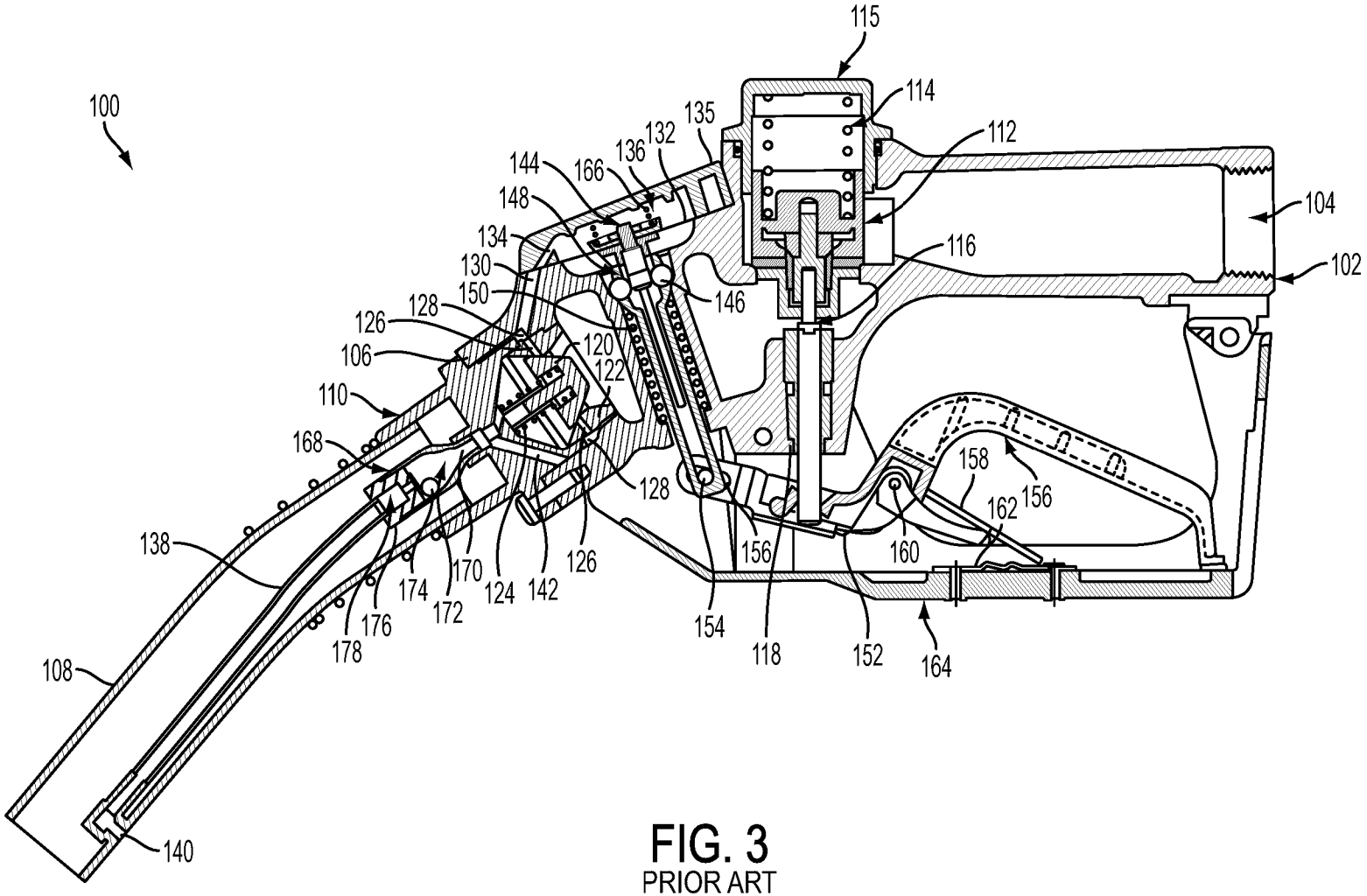
FIG. 3 PRIOR ART
FIG. 3 is a cross-sectional view of a prior art fuel dispensing nozzle.

FIG. 3 is a cross-sectional view of a prior art fuel dispensing nozzle 100. In general, certain aspects of the construction and operation of nozzle 100 are disclosed in U.S. Pat. No. 3,653,415, the entire disclosure of which is incorporated by reference herein for all purposes. Nozzle 100 is not configured for use with a vapor recovery fuel dispenser, but those of skill in the art will nonetheless appreciate that embodiments of the present invention may also be adapted for use in vapor recovery nozzles. Examples of vapor recovery liquid dispensing nozzles are described in U.S. Pat. Nos. 5,832,970 and 7,134,580, the disclosures of which are incorporated by reference herein in their entireties for all purposes.

More particularly, nozzle 100 comprises a nozzle body 102 which defines an inlet 104 to which a fuel supply hose may be connected to supply fuel to nozzle 100. Nozzle 100 further comprises an outlet 106 to which a spout 108 is connected via a spout adapter 110. As is well known, spout 108 is configured for insertion into a filler pipe of a vehicle's fuel tank or another suitable container. A main poppet valve 112 is supported in body 102 for controlling the flow of fluid through body 102 from inlet 102 to outlet 106. A spring 114 acting against a cap 115 continuously urges valve 112 to its closed position. A stem 116 is connected to valve 112 and has its lower portion extending exterior of body 102 through a guide 118. Guide 118 is formed of a suitable plastic material having a relatively low coefficient of friction to minimize the sliding friction between stem 116 and body 102.

A secondary poppet valve 120 is slidably mounted on spout adapter 110 and is continuously urged into engagement with a seating ring 122 via a spring 124. Spring 124 is sized such that only the pressure of fuel flowing from inlet 104 and past valve 112 can overcome spring 124 to move valve 120 to an open position. As fuel flows between poppet valve 120 and seating ring 122, a venturi effect is created in a plurality of passages 126 extending through seating ring 122 and communicating with an annular chamber 128. Annular chamber 128 communicates through a passage 130 in body 102, an opening in a diaphragm 132, and a passage 134 in a cap 135 to a chamber 136.

Chamber 136 is also in fluid communication with a tube 138 that is connected with an opening 140 defined in spout 108 adjacent the discharge end of spout 108. Tube 138 communicates with chamber 136 via a passage 142 defined in spout adapter 110 that is itself in communication with annular chamber 128. Accordingly, as long as the opening 140 is not closed by fuel within the fuel tank or container being filled reaching a predetermined level indicating that the tank/container is filled, the venturi effect created by the flow of fuel between seating ring 122 and poppet valve 120 draws air through tube 138. However, as soon as opening 140 is blocked, the pressure in chamber 136 is reduced by the air therein being drawn therefrom because of the venturi effect in the passages 128 in seating ring 122. As a result, diaphragm 132 moves upwardly due to the partial vacuum created in chamber 136.

Diaphragm 132 is held between nozzle body 102 and cap 135 to form a wall of chamber 136. A latch pin 144 is secured to diaphragm 132 for movement therewith. Latch pin 144 is disposed between three balls 146 (two shown) that are positioned within passages in a latch plunger 148 that is slidably mounted within body 102. When latch pin 144 is in the position shown in FIG. 3, balls 146 prevent downward movement of plunger 148. However, when diaphragm 132 is moved upwardly due to fuel blocking opening 140 in spout 108, latch pin 144 is correspondingly moved upwardly. This upward movement of latch pin 144 disposes a tapered portion of latch pin 144 between balls 146, whereby balls 146 may move inwardly. This allows plunger 148 to move downwardly against the force of a spring 150.

The lower end of latch plunger 148 is connected to a lower lever 152 by a pin 154. Pin 154, which is secured to latch plunger 148, extends through slots (one shown at 156) in bifurcated portions of lower lever 152 to provide a pin and slot connection between latch plunger 148 and lower lever 152. Thus, lower lever 152 can both pivot and slide relative to latch plunger 148. A portion of stem 116 of main poppet valve 112 extending exterior to nozzle body 102 also engages lower lever 152, as shown in FIG. 3.

Lower lever 152 is pivotally connected to a handle 156. Thus, as handle 156 moves upwardly, lower lever 152 engages valve stem 116 to move it upwardly against the force of spring 114 to open valve 112. This allows fluid to flow from inlet 104 to outlet 106 of body 102. To provide different flow rates, handle 156 may be held in any of three positions by a resiliently biased trigger 158, which is pivotally mounted on a rivet 160 and which engages a rack 162 disposed on a guard 164. Thus, trigger 158 is pivotally connected to both lower lever 152 and handle 156.

Trigger 158 holds handle 156 in the desired position until the tank is filled. When the tank is filed, opening 140 is blocked by the level of the fluid in the tank, whereby the latch plunger 148 is released from balls 146 due to the diaphragm 132 being moved upwardly because of the reduced pressure in the chamber 136. When plunger 148 is released, the force of spring 114 closes valve 12 by moving stem 116 downward against the lower lever 152 to pivot counterclockwise about rivet 160. This pulls plunger 148 downwardly.

Because handle 156 is held against movement by trigger 158 being disposed in rack 162, lower lever 152 pivots counterclockwise about rivet 160 during the downward movement of stem 116. Pin 154 moves to the leftmost (when viewed in FIG. 3) side of slot 156 when the maximum counterclockwise movement of lower lever 152 is completed with handle 156 still held by trigger 158. At this time, trigger 158 ceases to have sufficient force exerted thereon so that trigger 158 no longer has sufficient frictional engagement with the notch or step of the rack 162 to remain engaged therewith. As a result, the spring associated with trigger 158 pivots trigger 158 counterclockwise until trigger 158 engages handle 156. When trigger 158 has its end released from the notch or step of rack 162, handle 156 falls. As a result, plunger spring 150 returns the plunger 148 to the position shown in FIG. 3, in which plunger 148 is locked against downward movement. This results in lower lever 152 also being returned to the position of FIG. 3. When spout 108 has been removed from the tank being filled, opening 140 is no longer blocked. As a result, the pressure in the chamber 136 increases to allow a diaphragm spring 166, which acts on the upper surface of the diaphragm 132, to move diaphragm 132 downwardly and return latch pin 144 to the position shown in FIG. 3.

Further, nozzle 100 also includes an attitude device 168 configured to shutoff liquid dispensing if nozzle body 102 is tilted beyond a predetermined angle. Attitude device 168 is disposed upstream of tube 138 and downstream of passage 142 defined in spout adapter 110. Attitude device 168 defines an inlet opening 170 in fluid communication with passage 142 and a chamber 172. A ball 174 is provided in chamber 172, and a plug 176 traps ball 174 in chamber 172. Plug 176 defines a passage 178 in fluid communication with tube 138 and chamber 172.

In operation, attitude device 168 is configured to cause 112 to close and thus shutoff fuel dispensing at nozzle 100 if nozzle body 102 is moved substantially upwardly from a generally horizontal dispensing orientation. As will be appreciated, when nozzle 100 is held in the position shown in FIG. 3 (i.e., wherein nozzle body 102 is in a substantially horizontal position), attitude device 168 is not actuated, and fuel may be dispensed. If, however, a user were to move nozzle 100 from a substantially horizontal position to a more vertical position, ball 174, in response to gravity, will roll in chamber 172 into a position wherein it blocks inlet opening 170. When this occurs, the flow of air from opening 140 is again blocked, which causes a reduction in pressure in chamber 136 identical to that described above with respect to the condition where the tank being filled is full. As explained in detail above, this reduction in pressure causes valve 112 to close and shuts off liquid dispensing through nozzle 100.

In accordance with embodiments of the present invention, a nozzle for dispensing fluid from a fluid dispenser need not comprise some or all of the mechanical components described above with reference to nozzle 100. Such components increase the mass, complexity, and manufacturing cost of nozzle 100 and associated castings and components. In addition, prior art nozzles such as nozzle 100 typically require a larger force applied to the handle to actuate the nozzle, which is undesirable for some users. As described below, nozzles constructed in accordance with embodiments of the present invention may have a lower cost and complexity, reduced mass, and reduced actuation force, among other advantages. In some embodiments, flow control components previously located in the fluid dispensing nozzle may be located inside the associated fluid dispenser.

Further, in accordance with embodiments of the present invention, fluid flow rates at the nozzle may be regulated via ultrasonic communications transmitted along a fluid hose extending between the nozzle and the fluid dispenser. In particular, a small-diameter, flexible hose may be used as a waveguide for propagating ultrasonic waves. The ultrasonic waves are transmissible through the fluid(s) carried through the hose, such as (but not limited to) liquid fuel and recovered vapor. In this regard, the scientific literature has suggested that it may be feasible to modulate and transmit ultrasonic signals through crude oil. The testing was done with water as a transmission medium, rather than crude oil, but because fuels such as gasoline and diesel are more similar to water than crude oil is in terms of density (which affects the velocity of sound waves) and viscosity (which affects losses), the literature is applicable to gasoline, diesel fuel, and other liquids with similar physical properties. This research was done in the context of sea-based oil exploration, development, and transfer, and it did not address or contemplate ultrasonic wave propagation through small-diameter, flexible hoses, such as those used in fuel dispensing systems. As discussed below, the physics applicable to wave propagation between a fluid dispensing nozzle and a fluid dispenser through a fluid dispensing hose used as a waveguide require additional considerations not addressed in the scientific literature. Likewise, it has not been contemplated to use ultrasonic signals to control and/or regulate fluid flow rates at a fluid dispensing nozzle.

Those of skill in the art are familiar with ultrasonic transducers and associated electronics suitable for use with embodiments of the present invention. Ultrasonic transducers used in embodiments of the present invention may be of any suitable configuration, including contact-type, immersion, and/or angle beam ultrasonic transducers. In some embodiments, the ultrasonic transducers may be similar to ultrasonic transducers found in known ultrasonic flow meters. Additional background information regarding ultrasonic flow meters is provided in U.S. Pat. Nos. 7,954,387; 7,966,893; 6,390,999; and 4,527,433, and U.S. Pub. App. No. 2012/0006127, the entire disclosures of which are incorporated by reference herein for all purposes. In one embodiment, the ultrasonic transducers used may be analogous to the ultrasonic transducers offered by CTS Valpey Corporation of Hopkinton, Mass. It will be appreciated, however, that the term "ultrasonic" is used broadly herein to refer to sound pressure waves with frequencies greater than approximately 20 kHz, and is not limited to particular frequency ranges associated with commercially-available ultrasonic transducers.

Figure 4:
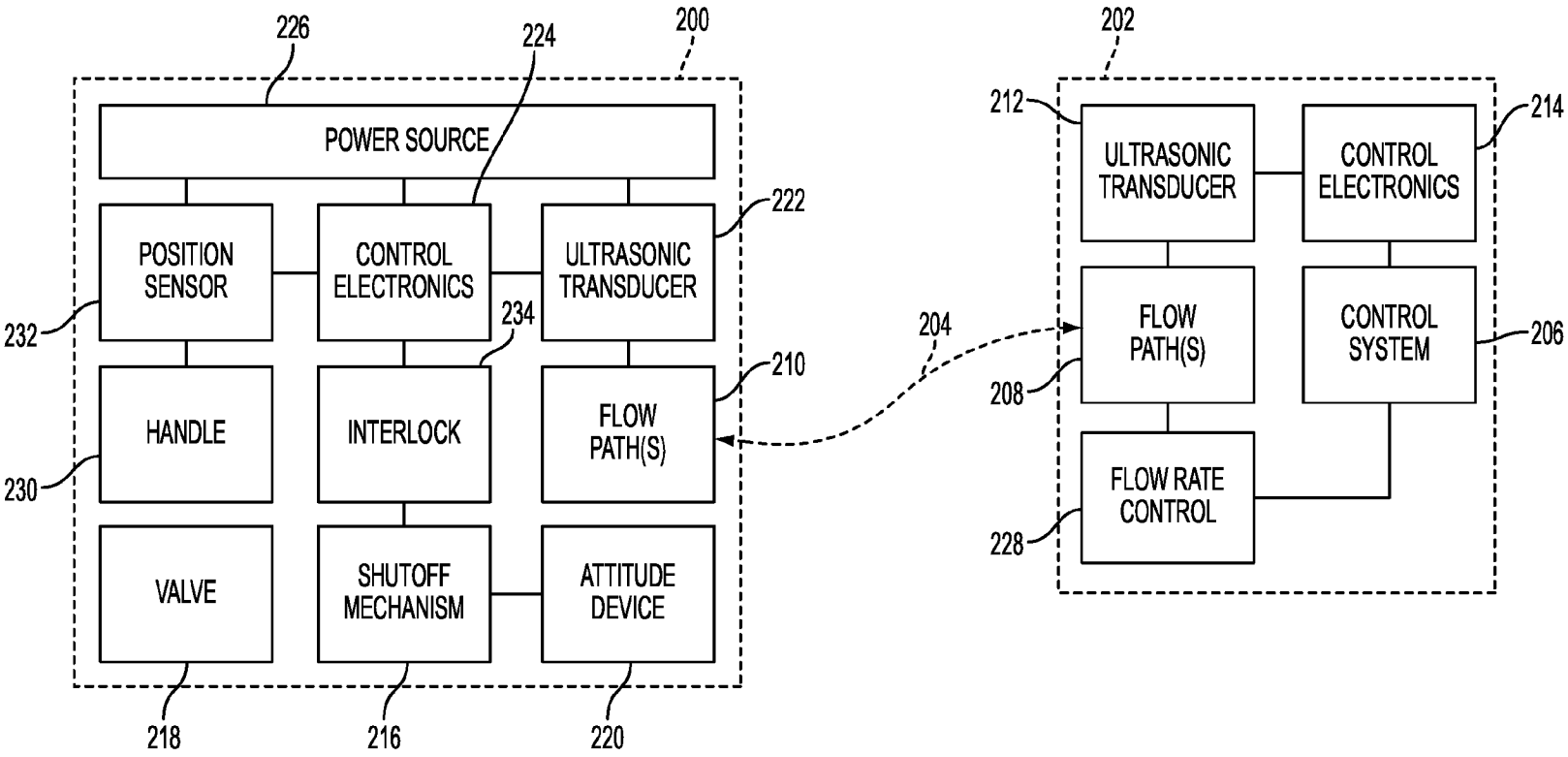
FIG. 4 is a block diagram of a fluid dispensing nozzle in ultrasonic communication with a fluid dispenser via a fluid dispensing hose in accordance with an embodiment of the present invention.

Additional detail regarding an embodiment of the present invention is provided with reference to FIG. 4, which is a block diagram of a fluid dispensing nozzle 200 in ultrasonic communication with a fluid dispenser 202 via a fluid dispensing hose 204. Fluid dispenser 202 may be configured to dispense any suitable fluid, including but not limited gaseous and liquid fuels such as gasoline, diesel, DEF, LPG, and LNG. In some embodiments, fluid dispenser 202 may be analogous to fuel dispenser 10, discussed above, but modified as set forth below. Thus, fluid dispenser 202 may comprise a control system 206 similar to control system 54 and internal flow paths 208 for fuel and, in some configurations, recovered vapor. Flow paths 208 may be analogous to internal fuel piping 48, internal vapor return piping 82, and manifold 76 described above. In one embodiment, hose 204 may be analogous to hose 14, described above, and thus may be a dual-channel hose defining concentric fluid flow paths therein, similar to product delivery line 78 and vapor return line 80. Hose 204 is operatively connected between flow paths 208 in fluid dispenser 202 and flow paths 210 for fuel and, in some configurations, recovered vapor in nozzle 200.

Fluid dispenser 202 preferably comprises at least one ultrasonic transducer 212 in electronic communication with control electronics 214. Control electronics 214, which are preferably in electronic communication with control system 206, may carry out the functional and control processing associated with ultrasonic transducer 212 and preferably comprise the hardware and software necessary to operate ultrasonic transducer 212 as described herein. For example, as described below, control electronics 214 are operative to modulate and/or demodulate ultrasonic waves transmitted from and received by ultrasonic transducer 212. Those of skill in the art are familiar with suitable modulation techniques which may be used with embodiments of the present invention, including amplitude modulation, such as on-off keying, frequency modulation, and frequency shift keying, among others. Also, control electronics 214 are operative to transmit to control system 206 information representative of a flow rate requested or desired by a user of nozzle 200. In other embodiments, control electronics 214 may be implemented as a part of control system 206.

In this regard, control electronics 214 may comprise one or more processors, microprocessors, programmable logic devices, or other processing components. In addition, control electronics 214 may comprise one or more volatile or non-volatile memory components that store information accessible to control electronics 214. Further, control electronics 214 may preferably comprise amplifiers, signal processors, and any other components commonly associated with control electronics for ultrasonic transducers with which those of skill in the art are familiar. In some embodiments, control electronics 214 may be analogous to the electronics used to control ultrasonic transducers in ultrasonic flow meters, as noted above.

Ultrasonic transducer 212 is preferably operatively connected to flow paths 208 such that ultrasonic transducer 212 may emit ultrasonic waves into and receive ultrasonic waves from flow paths 208. In many embodiments, transducer 212 is located in the housing of fluid dispenser 202 and is operative to direct ultrasonic waves into and receive ultrasonic waves from flow paths 208 via the most direct and unobstructed path possible. The ultrasonic waves transmitted from and received by transducer 212 travel along fluid dispensing hose 204 (or a particular channel therein), which is operatively connected to flow paths 208 and which acts as a waveguide for the ultrasonic waves.

Nozzle 200 may be similar in some respects to nozzle 100, but modified in accordance with embodiments of the present invention. Thus, for example, nozzle 200 may comprise a shutoff or overfill-detection mechanism 216 analogous to the mechanism of nozzle 100, described above, and thus nozzle 200 may comprise a valve 218 analogous to valve 120. As with valve 120, valve 218 may be biased to a closed position in the absence of fluid pressure in the flow path between fluid dispenser 202 and nozzle 200. Nonetheless, valve 218 is not required in all embodiments of the present invention. Further, nozzle 200 preferably comprises an attitude device 220 analogous to attitude device 168, also described above.

In addition, nozzle 200 preferably contains an ultrasonic transducer 222 in electronic communication with control electronics 224. Ultrasonic transducer 222 is preferably operatively connected to flow paths 210 such that ultrasonic transducer 222 may emit ultrasonic waves into and receive ultrasonic waves from flow paths 210. As with transducer 212, the ultrasonic waves transmitted from and received by transducer 222 travel along fluid dispensing hose 204 (or a particular channel therein), which is also operatively connected to flow paths 210. Control electronics 224 may preferably be similar to control electronics 214, and are likewise configured to modulate and/or demodulate ultrasonic waves transmitted from and received by ultrasonic transducer 222. Among other things, control electronics 224 may modulate ultrasonic waves transmitted from ultrasonic transducer 222 to carry information representative of a flow rate requested or desired by a user of nozzle 200. It will be appreciated that, in embodiments where nozzle 200 is used to dispense flammable fuel or recover flammable vapor, electronic components included in nozzle 200 may be physically isolated from contact with such fluids.

In various embodiments, transducers 212, 222 may be either wetted or nonwetted. Where transducers 212, 222 are wetted, they may be flush-mounted in paths 208, 210, respectively, via a suitable port. Where nonwetted, transducers 212, 222 may respectively be mounted on or spaced apart from the exterior of paths 208 and 210. In any event, it is contemplated that transducers 212, 222 are operative to produce ultrasonic waves having frequencies suitable for waveguide propagation in relatively small-diameter hoses.

Several considerations are applicable to the selection of suitable frequencies. For example, the frequency used should be above the frequencies of ambient acoustic noise in the fluid dispensing environment, such as the noises of pumps and motors that could interfere with lower frequency signals. However, generally speaking, the lowest practical frequency above an intrinsic, "low pass" cutoff of a given hose is likely to be desirable in many embodiments. In addition, attenuation losses will increase with frequency and may depend on the physical characteristics of the actual hose used as a waveguide, including the material of the hose and its diameter. Also, whereas waveguides purpose-designed for facilitating ultrasonic wave propagation are generally very smooth and straight, hoses used for dispensing fuel to automobiles are generally not. Thus, the frequency selected may be determined by experimentation on the particular hose chosen in some embodiments. In other embodiments, the available frequencies may be those used for non-destructive testing and evaluation. Further, in some embodiments, such frequencies may be at least several hundred kHz to about 10 MHz.

Ultrasonic transducer 212 and control electronics 214 may receive power from the mains power connected at fuel dispenser 202, and ultrasonic transducer 222 and control electronics 224 (among other components) may be powered by a power source 226 provided in nozzle 200. In embodiments where ultrasonic transducer 212 and control electronics 214 are used primarily for receiving ultrasonic signals, it will be appreciated that they may draw more power than ultrasonic transducer 222 and control electronics 224 in nozzle 200. The latter components would be used primarily for sending ultrasonic signals and would thus require less power. Accordingly, in some embodiments, ultrasonic transducer 222 and control electronics 224 may operate on a more limited power budget.

Power source 226 may be any suitable source of power operative to power the electronic components in nozzle 200. Those of skill in the art can select a suitable power source 226 based on a given system's configuration and power requirements. For example, in one embodiment, power source 226 may comprise a battery, capacitor, or another energy storage device. In another embodiment, power source 226 may comprise one or more solar panels in electrical communication with and capable of recharging a battery located in nozzle 200. In other embodiments, power source 226 may comprise a recharging circuit configured to receive electromagnetically coupled energy from an associated energy coupling system provided in dispenser 202. In still other embodiments, power source 226 may comprise an impeller disposed along flow paths 210 that is configured to generate power via electromagnetic induction. For example, the impeller may be operatively connected to a plurality of magnets configured to rotate within coils of a conductor. When turned by the flowing fluid, the impeller would cause rotation of the magnet which would, in turn, generate electricity which may be used to power the electronics in nozzle 200 or to recharge a battery. Additional information regarding power sources for fluid dispensing nozzles in provided in U.S. Pat. Nos. 4,005,412; 4,140,013; 5,184,309; 5,365,984; and 6,571,151, the disclosure of each of which is incorporated by reference herein in its entirety for all purposes.

Notably, nozzle 200 may not include certain fluid flow rate control components provided in prior art nozzles, such as main poppet valve 112 of nozzle 100. In accordance with embodiments of the present invention, flow rate control components 228 are instead provided in fluid dispenser 202. Flow rate control components 228 may comprise a proportional valve in electronic communication with control system 206. In one embodiment, such a proportional valve may be analogous to valve 50, described above. Flow rate control components 228 may preferably be provided along or in fluid communication with flow paths 208. As described in more detail below, flow rate control components 228 are preferably operative to control or regulate the flow rate of fluid flowing along flow paths 208 (and thus, the flow rate through nozzle 200) in response to ultrasonic signals from transducer 222 in nozzle 200. Those of skill in the art will appreciate that, in other embodiments, flow rate control components may additionally or alternatively comprise a variable-speed pump and associated controller.

It will be appreciated that by removing flow rate control components such as a main poppet valve from nozzle 200, nozzle 200 may have reduced weight and contain fewer components that wear over time. In addition, a user may operate nozzle 200 by imparting a reduced actuation force in comparison to prior art nozzles. In this regard, instead of including a main poppet valve assembly, as in nozzle 100, nozzle 200 may comprise a handle 230 operatively connected to a position sensor 232. Position sensor 232 may also receive power from power source 226. Position sensor 232, which may be incorporated within nozzle 200 or positioned on the body thereof, may preferably comprise an electronic transducer operative to output to control electronics 224 a signal indicative of the position of handle 230, for example relative to the handle's rest position. For instance, the magnitude of the signal may be proportional to the distance traveled by handle 230, and an increase in magnitude may represent a desired increase in the flow rate of fluid. Accordingly, the signal indicative of the position of handle 230 may also be indicative of the flow rate of fluid desired or requested by a user of nozzle 200. In another embodiment, position sensor 232 may be analogous to the position transducer described in U.S. Pat. No. 4,934,565, the entire disclosure of which is incorporated by reference herein for all purposes. In any event, the actuation force required to operate nozzle 200 is only the force required to operate position sensor 232, which may be substantially less than the force required to actuate a main poppet valve assembly.

In some embodiments, nozzle 200 may further comprise an interlock 234 operative to interrupt transmission of ultrasonic waves between nozzle 200 and fluid dispenser 202. More particularly, interlock 234 may be in operative communication with shutoff mechanism 216 such that actuation of shutoff mechanism 216 actuates interlock 234. As explained above, shutoff mechanism 216 may be triggered upon blocking of an opening in nozzle 200 analogous to opening 140 of nozzle 100 during filling or upon a ball of attitude device 220 moving into a position that blocks a tube analogous to tube 138 of nozzle 100. In one embodiment, interlock 234 may be coupled with a plunger analogous to plunger 148 (or a portion thereof) of nozzle 100, described above, such that actuation of the plunger due to an overfill condition or a change in nozzle 200's attitude may actuate interlock 234. Other methods of operative communication between interlock 234 and shutoff mechanism 216 and/or attitude device 220 are contemplated and are within the scope of the present invention. Interlock 234 may be coupled with a diaphragm analogous to diaphragm 132 and/or with a ball of attitude device 220, among other examples.

In one embodiment, interlock 234 may comprise a plurality of switches, all of which must be in a particular state to provide electrical communication between interlock 234 and control electronics 224. The default state of the switches may cause interlock 234 to be normally in electrical communication with control electronics 224. When either shutoff mechanism 216 or attitude device 220 is actuated, one or more of the switches of interlock 234 may change state, thereby interrupting electrical communication between control electronics 224 and interlock 234. Control electronics 224 may interpret the lack of electrical communication as an indication that ultrasonic transmissions should cease, and control electronics 224 may stop ultrasonic transmissions from ultrasonic transducer 222. Therefore, an overfill condition or movement of nozzle 200 to an upright position preferably ends transmission of ultrasonic waves from nozzle 200. In one embodiment, the plurality of switches may be wired together in series, but in another embodiment they can also be run independently and combined by logic (implemented either by hardware circuitry or software).

Figure 5:
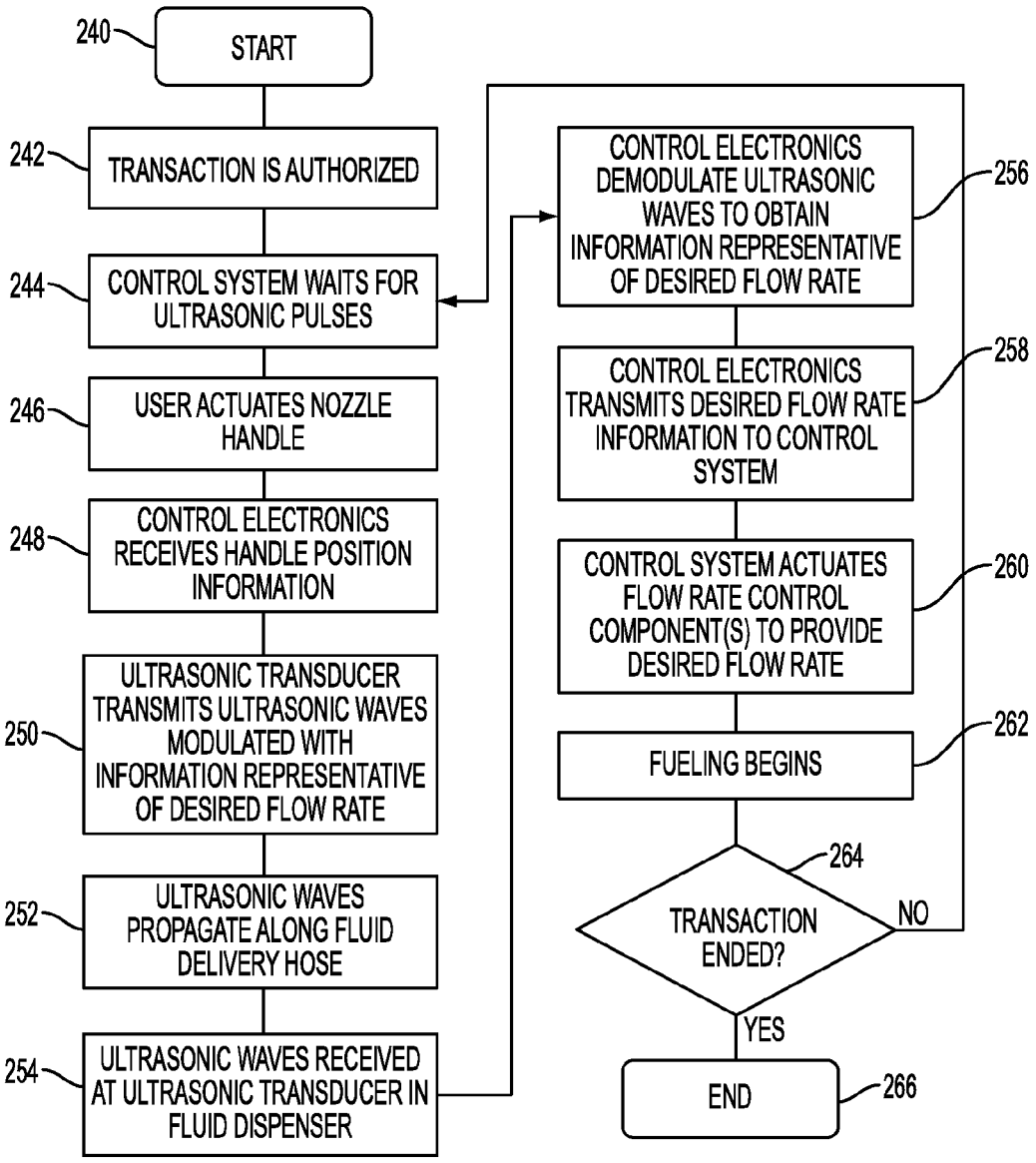
FIG. 5 is a flow chart illustrating steps of a method of regulating the flow rate of fluid at a fluid dispensing nozzle in accordance with an embodiment of the present invention.

The operation of nozzle 200 and dispenser 202 is described below with reference also to FIG. 5, which is a flow chart illustrating steps of a method of regulating the flow rate of fluid at nozzle 200 in accordance with an embodiment of the present invention. At step 240 the process begins, and at step 242 a transaction at fluid dispenser 202 is authorized. Control system 206 may then wait for ultrasonic pulses or waves carrying information representative of a flow rate desired by the user of dispenser 202 (step 244). If control system 206 determines that ultrasonic transducer 212 is not receiving ultrasonic waves for any reason, and at any point during the transaction, control system 206 may interpret the absence of ultrasonic waves as an indication that no fluid flow is needed or desired, and accordingly control system 206 may actuate flow rate control components 228 such that no fluid flow is provided. For example, control system 206 may detect an absence of ultrasonic waves when handle 230 is in the rest position or when shutoff mechanism 216 and/or attitude device 220 have been actuated. Further, where fluid dispenser 202 is a fuel dispenser, control system 206 may stop the flow of fuel during a "driveoff" condition. In particular, in the event a customer drives off with nozzle 200 left in his or her fuel tank, thereby causing nozzle 200 and/or hose 204 to separate from dispenser 202 and potentially actuating a breakaway valve, ultrasonic waves will not be received at ultrasonic transducer 212. Thus, control system 206 will actuate flow rate control components 228 to stop the flow of fuel, preventing leakage of fuel to the environment. In some embodiments, upon initiation of the transaction, control system 206 may send a signal in the manner described below to control electronics 224 alerting control electronics 224 that the transaction has been authorized and that control electronics 224 should send a signal representative of a desired flow rate, but this is not required.

Next, the user may actuate handle 230 of nozzle 200, moving it to a position which reflects the user's desired flow rate (step 246). Correspondingly, movement of handle 230 actuates position sensor 232. Position sensor 232 then sends information representative of the position of handle 230 to control electronics 224 (step 248). At step 250, control electronics 224 causes ultrasonic transducer 222 to transmit ultrasonic waves along flow paths 210 and into hose 204 that have been modulated with information representative of the position of handle 230 and, thus, of the user's desired flow rate.

The modulated ultrasonic waves propagate along fluid dispensing hose 204 (step 252) and then are received at ultrasonic transducer 212 in fluid dispenser 202 (step 254). Control electronics 214 may then demodulate the received ultrasonic waves to obtain information representative of the user's desired flow rate (step 256). Control electronics 214 may transmit this information to control system 206 (step 258). Based on the user's desired flow rate, control system 206 may then actuate flow rate control components 228 to provide the fluid flow rate desired (step 260). For example, control system 206 may open a proportional valve a sufficient amount to provide the desired flow rate, at which point fluid begins to flow from fluid dispenser 202, along hose 204, and to nozzle 200 (step 262).

At step 264, control system 206 may determine whether the transaction has ended. Those of skill in the art are aware of a variety of methods by which control system 206 may make this determination, but in one example, control system 206 may receive a signal from a sensor associated with a nozzle boot. When the user places nozzle 200 back into the nozzle boot, thereby indicating that the user is finished dispensing fluid, the sensor may signal control system 206 that the transaction is complete. If the transaction is complete, the process ends (step 266).

If, however, fluid dispensing is still ongoing, the process may return to step 244, where control system 206 waits for a new flow rate desired by the user. If the user moves handle 230 to a different position, for example squeezing the nozzle to indicate that more flow is desired, the above-described process repeats with control system 206 ultimately actuating flow rate control components 228 to provide greater flow. Likewise, the process repeats, ultimately resulting in reduced flow, if the user releases handle 230 somewhat from its earlier position. Further, if handle 230 is returned to its rest position (for example because the user is finished dispensing fluid and releases handle 230) the above process would repeat and result in control system 206 causing flow rate control components 228 to provide no fluid flow. Similarly, if either shutoff mechanism 216 or attitude device 220 is actuated, as noted above interlock 234 may cause control electronics 224 to stop transmission of ultrasonic waves, which results in control system 206 causing flow rate control components 228 to provide no fluid flow. In either case, due to the absence of fluid pressure in the flow path between fluid dispenser 202 and nozzle 200, valve 218 may be biased back to the closed position to prevent leakage of fluid from nozzle 200. Those of skill in the art will appreciate that the above-described process may provide for substantially continuous adjustment of the fluid flow rate at nozzle 200 as handle 230 changes position. Further, although in some embodiments there may be a discrete number of positions or states of flow rate control components 228 (and thus a discrete number of flow rates) based on the position of handle 230, in other embodiments it is contemplated that flow rate control components 228 be adjustable in proportion with any position of handle 230.

Those of skill in the art will appreciate that generating information representative of a user's desired flow rate at nozzle 200 in accordance with embodiments of the present invention is not limited to the use of position sensor 232 in operative communication with handle 230. Indeed, nozzle 200 need not comprise a handle at all in some embodiments. For example, in one embodiment, nozzle 200 may comprise a plurality of buttons, each associated with a predetermined flow rate (e.g., "high," "medium," and "low"). User actuation of a given button may send a signal to control electronics 224 comprising information representative of the flow rate associated with that button. In another embodiment, the buttons may take the form of "up" and "down" arrows. A user may press these buttons to select from among a plurality of predetermined flow rates, which may for example be provided on a scale of 1 (e.g., lowest flow) to 10 (e.g., highest flow). In yet another embodiment, nozzle 200 may comprise "start" and/or "stop" buttons for starting and stopping fluid flow, respectively, and the user may rotate a physical knob to adjust the rate of fluid flow. In a still further embodiment, nozzle 200 may comprise a "go" button that a user must continuously depress in order to cause fluid to flow. In some embodiments, such a button may be biased by a spring to a position at which no flow is provided, and in others the button may be analogous to a dome switch on a keypad. In further embodiments, nozzle 200 may comprise a lever or handle provided in an unconventional position, such as on top of nozzle 200. This may allow a user to actuate nozzle 200 via the user's thumb, as opposed to squeezing handle 230 with the user's fingers. In this regard, nozzle 200 is not required to have a main poppet valve and an associated spring strong enough to bias the valve to a closed position under the pressure of fluid that is pumped to the nozzle, and thus thumb actuation of nozzle 200 is possible.

In some embodiments, ultrasonic waves transmitted between nozzle 200 and fluid dispenser 202 may be modulated with information other than information regarding the user's desired flow rate. As one example, control electronics 224 may cause ultrasonic transducer 222 to transmit ultrasonic waves modulated with information regarding nozzle 200 itself. Such information could be a unique identification code assigned to each nozzle and programmed in control electronics 224 during manufacture. This information, which may also be stored in control electronics 214 or control system 206 during installation of nozzle 200 at dispenser 202, may allow either control electronics 214 or control system 206 to verify that nozzle 200 has not been changed, for example to prevent fraud or to ascertain the authenticity of replacement equipment. Any other information may be carried by ultrasonic waves, including maintenance information, such as the last time nozzle 200 was serviced; information regarding the status of power source 226; and statistical information regarding the usage of and/or transactions at nozzle 200.

It can thus be seen that embodiments of the present invention provide novel systems and methods for controlling and regulating the flow rate of fluid through a fluid dispensing nozzle using ultrasonic communications. Notably, in embodiments of the present invention, fluid flow rate control components, including but not limited to proportional valves, may be located remotely from the fluid dispensing nozzle, rather than inside of the nozzle as in the prior art. This may lower the cost and complexity of nozzle castings and components, reducing both nozzle mass and the force necessary to operate the nozzle. This may be advantageous for a fluid dispensing station because nozzles generally have a finite lifetime due to component wear and rough treatment. Further, embodiments of the present invention provide an intrinsically failsafe fluid dispensing system, in that the absence of received ultrasonic waves, for any reason, may be interpreted as a request for no fluid flow. Shutoff or interrupt devices in currently available nozzles may be configured to interrupt the transmission of ultrasonic pulses in embodiments of the present invention.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A fluid dispensing nozzle, comprising:

a body;

a spout coupled with said body;

at least one fluid flow path disposed within said body, said at least one fluid flow path configured for fluid communication with a fluid dispensing hose;

an ultrasonic transducer disposed within said body and operatively coupled with said at least one flow path; and control electronics in electronic communication with said ultrasonic transducer;

wherein said control electronics are operative to cause said ultrasonic transducer to transmit ultrasonic waves into said at least one fluid flow path;

wherein said ultrasonic waves are modulated at the time of transmission with information representative of a desired fluid flow rate.

2. The nozzle of claim 1, further comprising a handle.

3. The nozzle of claim 2, further comprising a position sensor operatively connected with said handle and in electronic communication with said control electronics.

4. The nozzle of claim 3, wherein actuation of said handle causes said position sensor to provide information representative of the position of said handle to said control electronics.

5. The nozzle of claim 1, further comprising at least one button in electronic communication with said control electronics, wherein actuation of said at least one button provides information representative of said desired flow rate to said control electronics.

6. The nozzle of claim 1, further comprising a shutoff mechanism.

7. The nozzle of claim 6, further comprising an attitude device.

8. The nozzle of claim 6, further comprising an interlock operatively coupled with said shutoff mechanism and in electronic communication with said control electronics.

9. The nozzle of claim 1, further comprising a power source in electrical communication with said control electronics and said ultrasonic transducer.

10. The nozzle of claim 1, further comprising a valve disposed along said flow path, said valve being biased to a closed position in the absence of fluid flow.

11. The nozzle of claim 1, wherein said ultrasonic waves are modulated with information representative of the identification of said nozzle.

12. The nozzle of claim 1, wherein said nozzle is a vapor recovery nozzle.

13. A fluid dispenser, comprising:

a housing;

at least one fluid flow path disposed within said housing, said at least one fluid flow path configured for fluid communication with a fluid dispensing hose;

a control system;

an ultrasonic transducer in electronic communication with said control system, said ultrasonic transducer operatively coupled with said at least one flow path;

at least one flow control component in electronic communication with said control system, said at least one flow control component disposed along said at least one fluid flow path and operative to adjust the flow rate of fluid in said at least one fluid flow path;

wherein said ultrasonic transducer is operative to receive ultrasonic waves propagating along said at least one flow path;

wherein said ultrasonic waves are modulated at the time they are transmitted with information representative of a desired fluid flow rate.

14. The fluid dispenser of claim 13, wherein said fluid is liquid fuel.

15. The fluid dispenser of claim 13, wherein said at least one flow control component is a proportional valve.

16. The fluid dispenser of claim 13, further comprising control electronics in electronic communication with said ultrasonic transducer and operative to demodulate said ultrasonic waves.

17. The fluid dispenser of claim 13, wherein said control system is operative to actuate said at least one flow control component based on said information representative of said desired fluid flow rate.

18. A method of regulating the flow rate of fluid at a nozzle in fluid communication with a fluid dispenser, said method comprising the steps of:

transmitting, from an ultrasonic transducer located in said nozzle, ultrasonic waves modulated at the time of transmission with information representative of a desired fluid flow rate, said ultrasonic waves propagating along a fluid dispensing hose extending between said nozzle and said fluid dispenser;

receiving, at an ultrasonic transducer located in said fluid dispenser, said ultrasonic waves modulated with information representative of said desired fluid flow rate;

demodulating said ultrasonic waves to obtain said information representative of said desired fluid flow rate; and adjusting at least one flow control component disposed along a flow path in said fluid dispenser based on said information representative of said desired fluid flow rate.

19. The method of claim 18, wherein said fluid dispensing hose is a dual-channel hose.

20. The method of claim 19, wherein said ultrasonic waves propagate through fluid flowing along a channel of said dual-channel hose.

21. The method of claim 18, further comprising the step of receiving, at control electronics located in said nozzle, information representative of a position of a handle of said nozzle.

22. The method of claim 18, further comprising the step of interrupting said transmission of said ultrasonic waves from said ultrasonic transducer located in said nozzle based on actuation of an interlock located in said nozzle.

* * * * *